US006234181B1

(12) United States Patent
Lou

(10) Patent No.: US 6,234,181 B1
(45) Date of Patent: May 22, 2001

(54) ROUGE POWDER BRUSH STRUCTURE

(75) Inventor: Kun-Lan Lou, Changhua (TW)

(73) Assignee: Jia Hsing Enterprises Co., Ltd., Changhua (TW)

( * ) Notice: Subject to any disclaimer, the term of this patent is extended or adjusted under 35 U.S.C. 154(b) by 0 days.

(21) Appl. No.: 09/478,546

(22) Filed: Jan. 6, 2000

(51) Int. Cl.[7] ..... A45D 44/18; A45D 40/24; A45D 40/26; B43K 5/16

(52) U.S. Cl. ..... 132/313; 132/317; 132/318; 401/102

(58) Field of Search ..... 132/313, 314, 132/315, 316, 317, 318; 401/102, 117; 15/167.1

(56) References Cited

U.S. PATENT DOCUMENTS 3,359,991 * 12/1967 Spatz ..... 132/313
4,842,132 * 6/1989 Wells ..... 132/313
5,339,483 * 8/1994 Byun ..... 132/313
5,377,842 * 1/1995 Sorini ..... 132/313
6,039,051 * 3/2000 Dorf ..... 132/313
6,039,052 * 3/2000 Choi ..... 132/313

* cited by examiner

*Primary Examiner*—Jeffrey A. Smith
*Assistant Examiner*—Robyn Kieu Doan
(74) *Attorney, Agent, or Firm*—Bacon & Thomas, PLLC

(57) ABSTRACT

The rouge powder brush structure which can be more simply used and conveniently carried. The rouge powder is contained inside the rouge powder brush so that it is no more necessary to carry a rouge cake case outdoors. The rouge powder brush structure including an upper fitting cap, a press key cap, a linking key cap, a large spring, an upper ventilating sleeve, a stopper block, a ball valve, a small spring, a lower ventilating sleeve, a receiving barrel, a movable binding collar, a locking sleeve and a cap body.

1 Claim, 4 Drawing Sheets

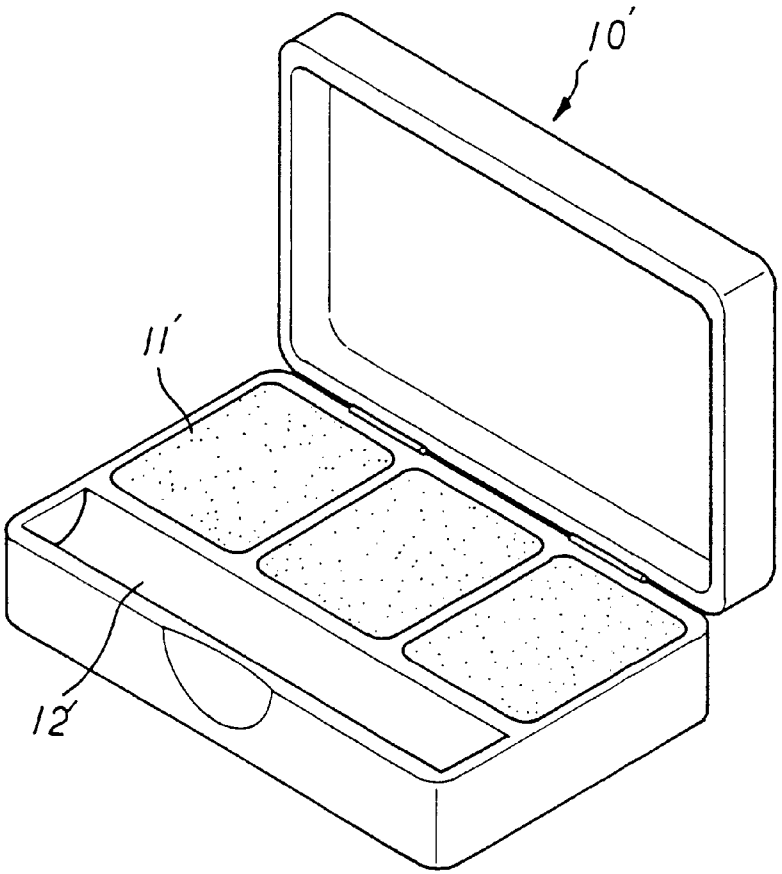
FIG. 1
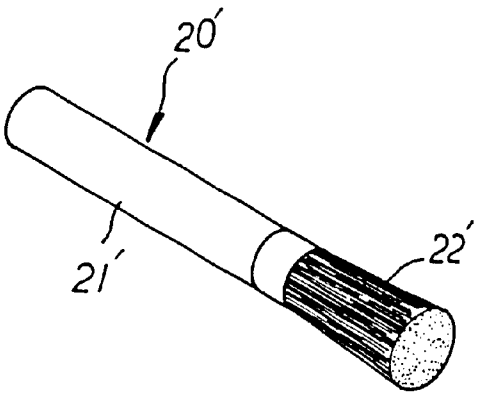

ROUGE POWDER BRUSH STRUCTURE

BACKGROUND OF THE INVENTION

The present invention relates to a rouge powder brush structure which can be more simply used and conveniently carried. The rouge powder is contained inside the rouge powder brush so that it is no more necessary to carry a rouge cake case outdoors. When the rouge powder brush is carried in a handbag, the rouge powder will not drop into the handbag to contaminate the clothes so that the handbag can be kept clean and the rouge powder will not be wasted.

A conventional rouge cake case 10' serves to contains therein and a rouge cake 11'. The rouge cake case 10' is formed with a powder brush cavity 12' on lower side in which a rouge powder brush 20' is received. The rouge powder brush 20' is composed of a brush stem 21' and a brush hair section 22' fixed at the front end of the brush stem 21'. When carried outdoors, the rouge cake case 10' containing therein the rouge cake 11' and the rouge powder brush 20' is directly placed in a handbag.

The conventional rouge cake case has some shortcomings as follows:

1. After using the rouge cake 11', the rouge powder brush 20' is placed into the powder brush cavity 12' and then the rouge cake case 10' is closed and placed into the handbag. When swung, the rouge cake 11' tends to drop into the rouge cake case 10' so that it is difficult to keep the rouge cake case 10' clean.
2. The rouge powder brush 20' is used in cooperation with the rouge cake case 10'. This leads to inconvenience in use and carriage.

SUMMARY OF THE INVENTION

It is therefore a primary object of the present invention to provide a rouge powder brush structure in which the brush hair section of the rouge powder brush is disposed with a movable binding collar and fitted with a cap body. When the rouge powder brush is carried in a handbag, the rouge powder will not drop into the handbag so that the handbag can be kept clean and the rouge powder will not be wasted.

It is a further object of the present invention to provide the above rouge powder brush structure in which the rouge powder brush contains therein the rouge powder which will directly attach to the brush hair section for cosmetic use. Therefore, the rouge powder brush can be more simply used and conveniently carried.

The present invention can be best understood through the following description and accompanying drawings wherein:

BRIEF DESCRIPTION OF THE DRAWINGS

FIG. 1 is a perspective view of a conventional rouge cake case and rouge powder brush;

DETAILED DESCRIPTION OF THE PREFERRED EMBODIMENT

Figure 2:
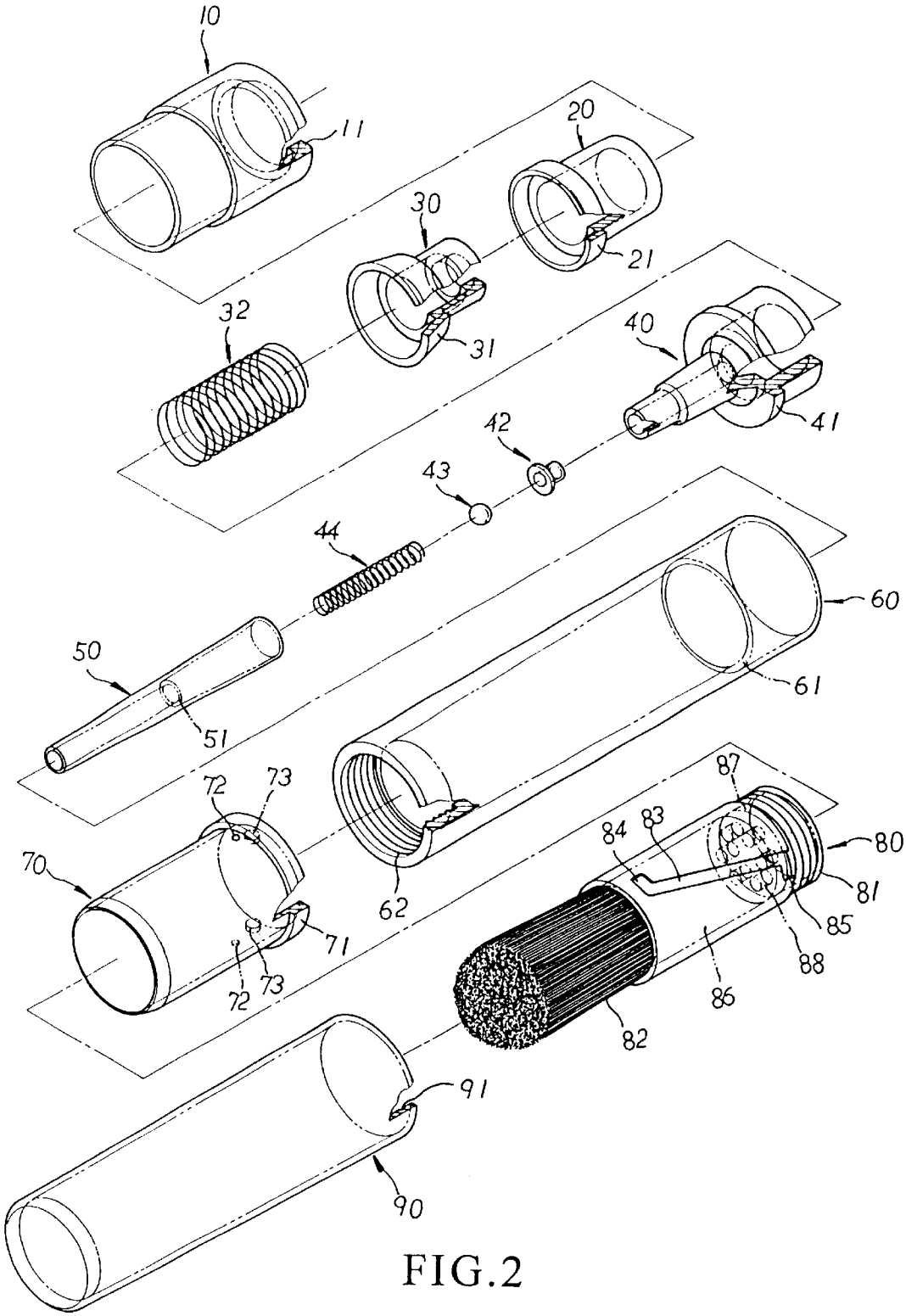
FIG. 2 is a perspective exploded view of the rouge powder brush of the present invention.

Please refer to FIG. 2. The present invention includes an upper fitting cap 10, a press key cap 20, a linking key cap 30, a large spring 32, an upper ventilating sleeve 40, a stopper block 42, a ball valve 43, a small spring 44, a lower ventilating sleeve 50, a receiving barrel 60, a movable binding collar 70, a locking sleeve 80 and a cap body 90. The upper fitting cap 10 is a hollow cylindrical body with a front small diameter section and a rear large diameter section. The rear end of the upper fitting cap 10 is formed with an inward extending stopper flange 11. The press key cap 20 is a hat-like body having a hat band-shaped engaging flange 21 having an inner slope face. The linking key cap 30 is a two-stepped hollow cylindrical body. The large step of the linking key cap 30 has inner and outer inclined engaging faces 31. The upper ventilating sleeve 40 is a funnel-shaped body. The rear section thereof is formed with an annular locating projecting ring 41. The stopper block 42 is a hollow cylindrical body with a front large diameter section and a rear small diameter section. The lower ventilating sleeve 50 is a hollow elongated conic body. The interior thereof is formed with a relatively small diameter stopper section 5l which extends forward. The receiving barrel 60 is a hollow elongated cylindrical body. The interior thereof is formed with a relatively small diameter retaining section 61 which extends forward. The front section is formed with inner thread 62. The movable binding collar 70 is a hollow cylindrical body. The rear section thereof is a relatively large diameter engaging section 71. The outer circumference thereof is formed with two opposite circular protuberances 72. The inner circumference of the rear section is formed with two opposite circular bosses 73. The rear section of the locking sleeve 80 is formed with outer thread 81. The front end thereof is fixed with a brush hair section 82. The circumference is formed with a slide channel 83 with a certain depth. The front and rear ends of the slide channel 83 are respectively formed with a front and a rear rectangular locating dents 84, 85 in reverse directions. The interior is formed with a front and a rear chambers 86, 87 communicating with each other through four perforations 88. The rear section of the inner circumference of the cap body 90 is formed with an annular groove 91 near the opening.

Figure 3:
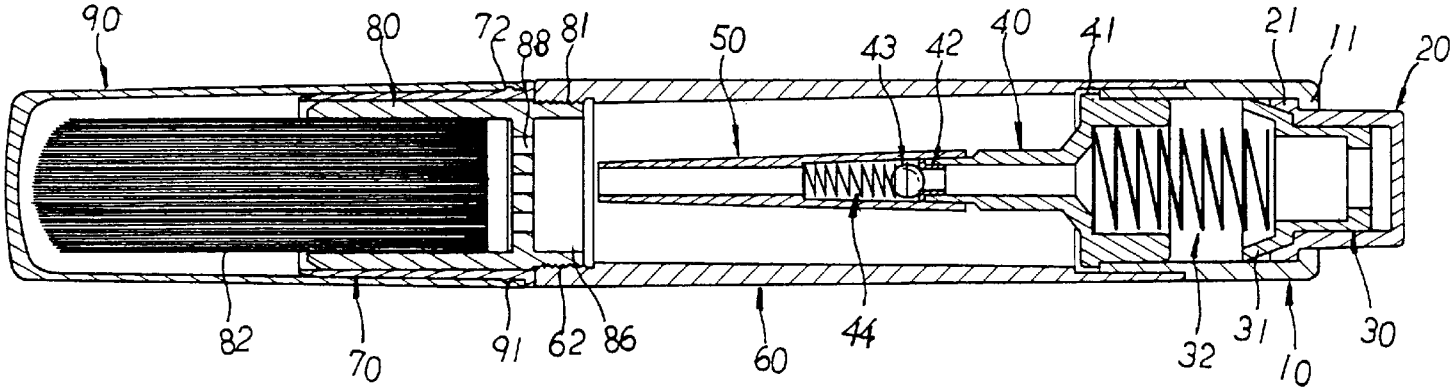
FIG. 3 is a sectional assembled view of the rouge powder brush of the present invention.
Figure 4A:
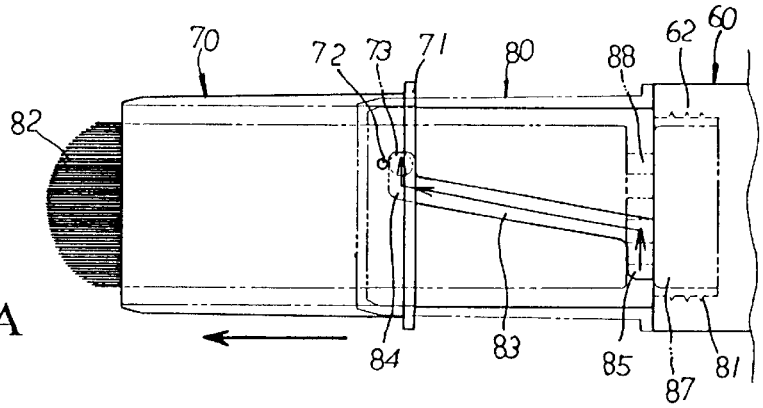
FIGS. 4A to 4C are sectional assembled views of the rouge powder brush of the present invention, showing that the cap body is fitted onto the locking sleeve of the present invention.
Figure 4B:
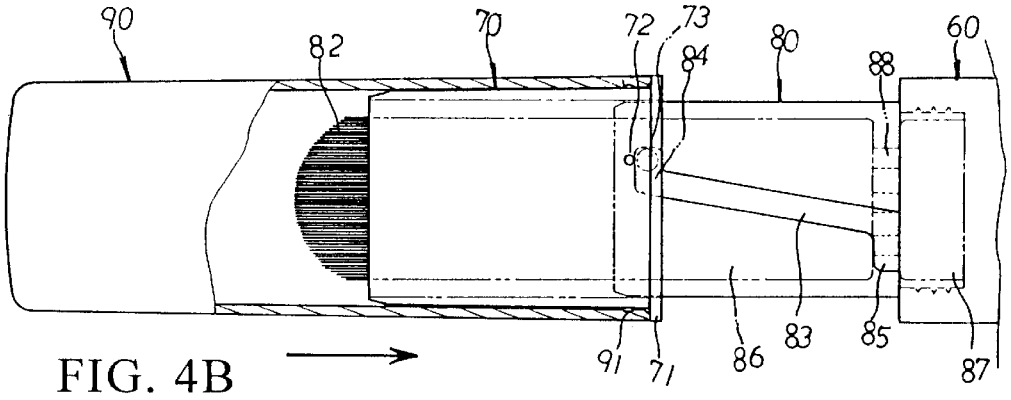
Figure 4C:
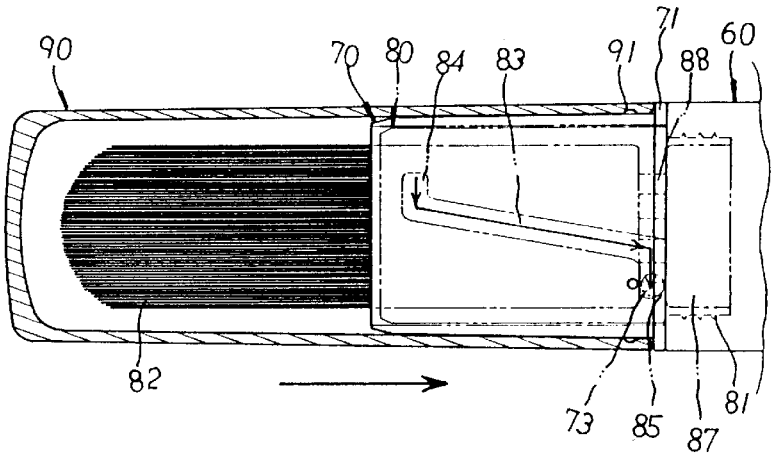

Referring to FIG. 3, when assembled, the stopper block 42 is first fitted into the front end of the upper ventilating sleeve 40. Then the small spring 44 is placed into the lower ventilating sleeve 50 with the stopper section 51 thereof abutting against the front end of the small spring 44. Then the ball valve 43 is positioned at the rear end of the small spring 44. The assembled upper ventilating sleeve 40 and the stopper block 42 are inserted into the rear end of the lower ventilating sleeve 50. The above assembly is placed into the rear end of the receiving barrel 60. The locating projecting ring 41 of the upper ventilating sleeve 40 is engaged with the retaining section 61 of the receiving barrel 60. The linking key cap 30 is placed into the front opening of the press key cap 20. The engaging flange 21 of the press key cap 20 is engaged with the stopper flange 12 of the upper fitting cap 10. The rear section of the press key cap 20 is protruded out of the upper fitting cap 10. Then the large spring 32 is placed into the rear section of the upper ventilating sleeve 40 and the upper fitting cap 10 is inserted into the rear end of the receiving barrel 60. Then the movable binding collar 70 is fitted into the rear end of the locking sleeve 80. The outer thread 81 of the locking sleeve 80 is screwed with the inner thread 62 of the receiving barrel 60. Then the movable binding collar 70 is turned forward by a certain angle to make the locating bosses 73 of the movable binding collar 70 engaged and fixed in the front locating dent 84. Under such circumstance, the brush hair section 82 of the locking sleeve 80 is protected therein as a bundle. The cap body 90 is fitted onto the front end of the movable binding collar 70 with the two circular protuberances 72 thereof engaged in the annular groove 91 of the cap body 90. Finally, the cap body 90 is turned rearward by a certain angle. At this time, the movable binding collar 70 is drivingly moved rearward to make the locating bosses 73 thereof engaged and fixed in the rear locating dent 85 ( referring to FIG. 4 ). At this time, the assembly is completed.

Figure 5:
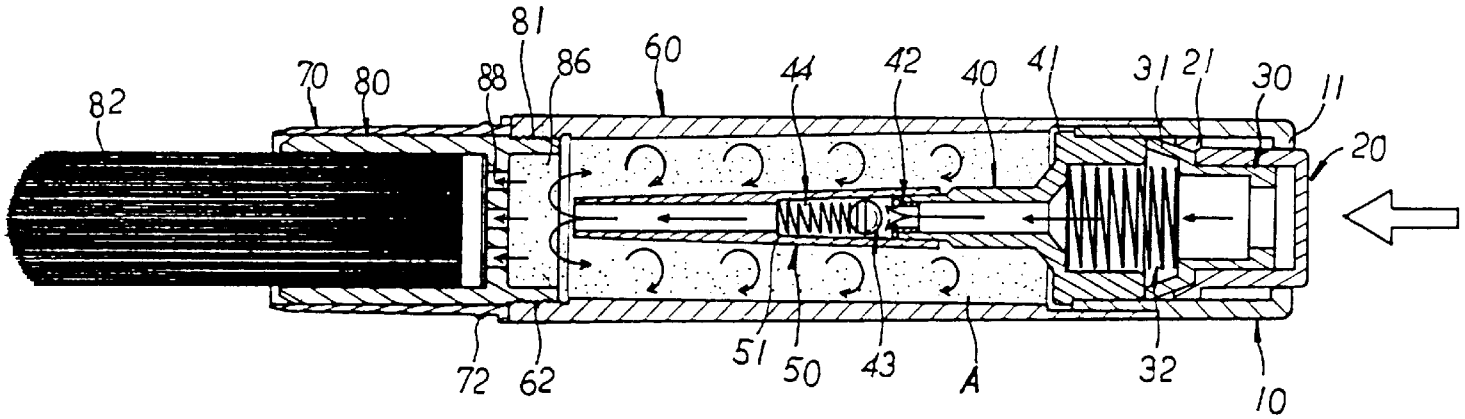
FIG. 5 is a sectional assembled view of the rouge powder brush of the present invention, showing the use thereof.

FIG. 5 is a sectional view showing the use of the present invention. In use, the cap body 90 is opened and then the press key cap 20 is pressed to drivingly forward press the linking key cap 30 and the large spring 32. The compressed air forward pushes the ball valve 43 and opens the stopper block 42, whereby the air can flow out therethrough. Then the air flows through the lower ventilating sleeve 50 into the receiving barrel 60. The air then flows all over the interior of the receiving barrel 60 to blow up the rouge powder A. Then the air and the blown up rouge powder A will flow out from the perforations 88 to attach to the brush hair section 82 for cosmetic use. When the press key cap 20 is released and the air pressure is insufficient, the small spring 44 will push the ball valve 43 to seal the stopper block 42.

According to the above arrangement, the present invention has the following advantages:

1. The brush hair section 82 of the locking sleeve 80 is disposed with a movable binding collar 70 and fitted with a cap body 90. When the rouge powder brush is carried in a handbag, the rouge powder A will not drop into the handbag so that the handbag can be kept clean and the rouge powder A will not be wasted.
2. The rouge powder brush contains therein the rouge powder A which will directly attach to the brush hair section 82 for cosmetic use. Therefore, the rouge cake case is no more necessary and the rouge powder brush can be more simply used and conveniently carried.

The above embodiment is only used to illustrate the present invention, not intended to limit the scope thereof. Many modifications of the above embodiment can be made without departing from the spirit of the present invention.

What is claimed is:

1. Rouge powder brush structure comprising an upper fitting cap, a press key cap, a linking key cap, a large spring, an upper ventilating sleeve, a stopper block, a ball valve, a small spring, a lower ventilating sleeve, a receiving barrel, a movable binding collar, a locking sleeve and a cap body, said rouge powder brush structure being characterized in that:

the upper fitting cap is a hollow cylindrical body with a front small diameter section and a rear large diameter section, the rear end of the upper fitting cap being formed with an inward extending stopper flange;

the press key cap is a hat-like body having a hat band-shaped engaging flange having an inner slope face;

the linking key cap is a two-stepped hollow cylindrical body, the large step of the linking key cap having inner and outer inclined engaging faces;

the upper ventilating sleeve is a funnel-shaped body, the rear section thereof being formed with an annular locating projecting ring;

the stopper block is a hollow cylindrical body with a front large diameter section and a rear small diameter section;

the lower ventilating sleeve is a hollow elongated conic body, the interior thereof being formed with a relatively small diameter stopper section which extends forward;

the receiving barrel is a hollow elongated cylindrical body, the interior thereof being formed with a relatively small diameter retaining section which extends forward, the front section thereof being formed with inner thread;

the movable binding collar being a hollow cylindrical body, the rear section thereof being a relatively large diameter engaging section, the outer circumference thereof being formed with two opposite circular protuberances, the inner circumference of the rear section being formed with two opposite circular bosses;

the rear section of the locking sleeve being formed with outer thread, the front end thereof being fixed with a brush hair section, the circumference thereof being formed with a slide channel with a certain depth, the front and rear ends of the slide channel being respectively formed with a front and a rear rectangular locating dents in reverse directions, the interior being formed with a front and a rear chambers communicating with each other through several perforations; and the rear section of the inner circumference of the cap body is formed with an annular groove near the opening, whereby the stopper block is fitted into the front end of the upper ventilating sleeve and the small spring is placed on rear side of the stopper section of the lower ventilating sleeve, the ball valve being positioned at the rear end of the small spring, the assembled upper ventilating sleeve and the stopper block being inserted into the rear end of the lower ventilating sleeve, the locating projecting ring of the upper ventilating sleeve being engaged with the rear side of the retaining section of the receiving barrel, the linking key cap being fitted into the press key cap, the engaging flange of the press key cap being engaged with the stopper flange of the upper fitting cap, the rear section of the press key cap being protruded out of the upper fitting cap, the large spring being placed into the rear section of the upper ventilating sleeve, the upper fitting cap being inserted into the rear end of the receiving barrel, the movable binding collar being fitted into the rear end of the locking sleeve, the outer thread of the locking sleeve being screwed with the inner thread of the receiving barrel, the cap body being fitted onto the movable binding collar with the two circular protuberances thereof engaged in the annular groove of the cap body.

* * * * *